United States Patent [19]

Wallmark

[11] 4,328,536

[45] May 4, 1982

[54] ARRANGEMENT IN WORKING LAMPS

[76] Inventor: Roger Wallmark, Fullriggaregatan 19, S-421 74 Göteborg, Sweden

[21] Appl. No.: 110,092

[22] Filed: Jan. 7, 1980

[30] Foreign Application Priority Data

Feb. 9, 1979 [SE] Sweden ..... 7901156

[51] Int. Cl.[3] ..... F21M 3/18

[52] U.S. Cl. ..... 362/427; 362/396; 362/432; 362/401; 362/413

[58] Field of Search ..... 362/396, 427, 432, 413, 362/401

[56] References Cited

U.S. PATENT DOCUMENTS 2,833,504 5/1958 Sacksteder ..... 362/427 X 4,165,530 8/1979 Sowden ..... 362/427 X

*Primary Examiner*—Stephen J. Lechert, Jr.

*Attorney, Agent, or Firm*—Harness, Dickey & Pierce

[57] ABSTRACT

An arrangement in working lamps intended for close-range illumination of working areas, such as desks, working benches and the like. This type of lamps generally comprise an upper pivotable arm which supports the light fittings, a lower pivotable arm which is attached to the working area, and various kinds of spring means to take moments of leverage.

The purpose of the invention is to simplify such prior-art structures while at the same time retain a maximum of possible positions of the lamp.

In accordance with the invention, this purpose is achieved by the provision of a rail extending from a segment positioned between the upper and the lower pivotable arm essentially in parallel with the lower arm, to a guide means in a housing in which the lower end of the lower arm is pivotally mounted. The rail cooperates with the housing by means of a pin-and-slot coupling arrangement in which the slot serves to guide the pin and is arranged to take on one of its edges any moments of load exerted by the light fittings in any one of their set positions.

3 Claims, 4 Drawing Figures

ARRANGEMENT IN WORKING LAMPS

BACKGROUND OF THE INVENTION

The subject invention concerns an arrangement in working lamps of the kind comprising an upper pivotable arm supporting the light fittings proper, and a lower pivotable arm which is arranged for pivotal movements about a horizontal shaft provided in a housing at the lower end of the lower arm, said pivotable arms being interconnected by a segment and hingedly connected thereto for pivotal movement, each about its respective pivot shaft.

Working lamps for close-range illumination of working areas, such as desks, working benches, machines and the like are usually provided with pivotable arms of the above-mentioned kind in order to maximize the range and positions of adjustment of the lamp. Since in this kind of lamps the light fittings are normally positioned at the extreme end of the upper pivotable arm, i.e. at the remote end from the point of attachment of the lamp, the lamp has a tendency to buckle up about its attachment.

It is known to arrange the upper and/or the lower pivotable arm as double parallel rods including spring means to counter-act the moments tending to tilt the pivotable arms supporting the fittings. The parallel rods form levers with which the springs can cooperate. In addition, this arrangement has the advantage that when the lower arm is lowered to move the light laterally, the angle of the light fittings to the illuminated surface remains substantially the same.

Similar types of lamps are known showing combinations of frictional joints and lever-arm joints and springs cooperating therewith.

SUMMARY OF THE INVENTION

The subject invention provides a working lamp the construction of which is less complicated than conventional lamps while at the same time it provides maximum safety against unwanted tilting or buckling up, in addition to which it is both sturdy and durable. A further advantage is that when the lower arm is displaced in order to move the light fittings in the lateral direction, the level of the lamp above the illuminated surfaces remains substantially unchanged.

The invention is characterised by a rail which extends essentially in parallel with the lower pivotable arm and which is pivotally connected to the segment about a third pivot shaft, said rail being axially displaceable in a guide means relative to the lower pivotable arm and cooperating with the housing by means of a pin-and-slot coupling arrangement, wherein the slot serves as a track to guide the pin and extends in a curve from a maximum radial distance from the lower pivot shaft of the lower pivotable arm to a minimum distance from said shaft, in addition to which said slot serves to take on one of its edges any moments of load exerted by the light fittings in any one of their set positions and transmitted via the upper pivotable arm, the segment and the rail.

In accordance with one aspect of the invention the rail is provided with said pin and said slot is formed in the wall of the housing.

BRIEF DESCRIPTION OF THE DRAWINGS

One embodiment of the invention will be described in closer detail in the following with reference to the accompanying drawings, wherein.

DETAILED DESCRIPTION OF A PREFERRED EMBODIMENT

Figure 1:
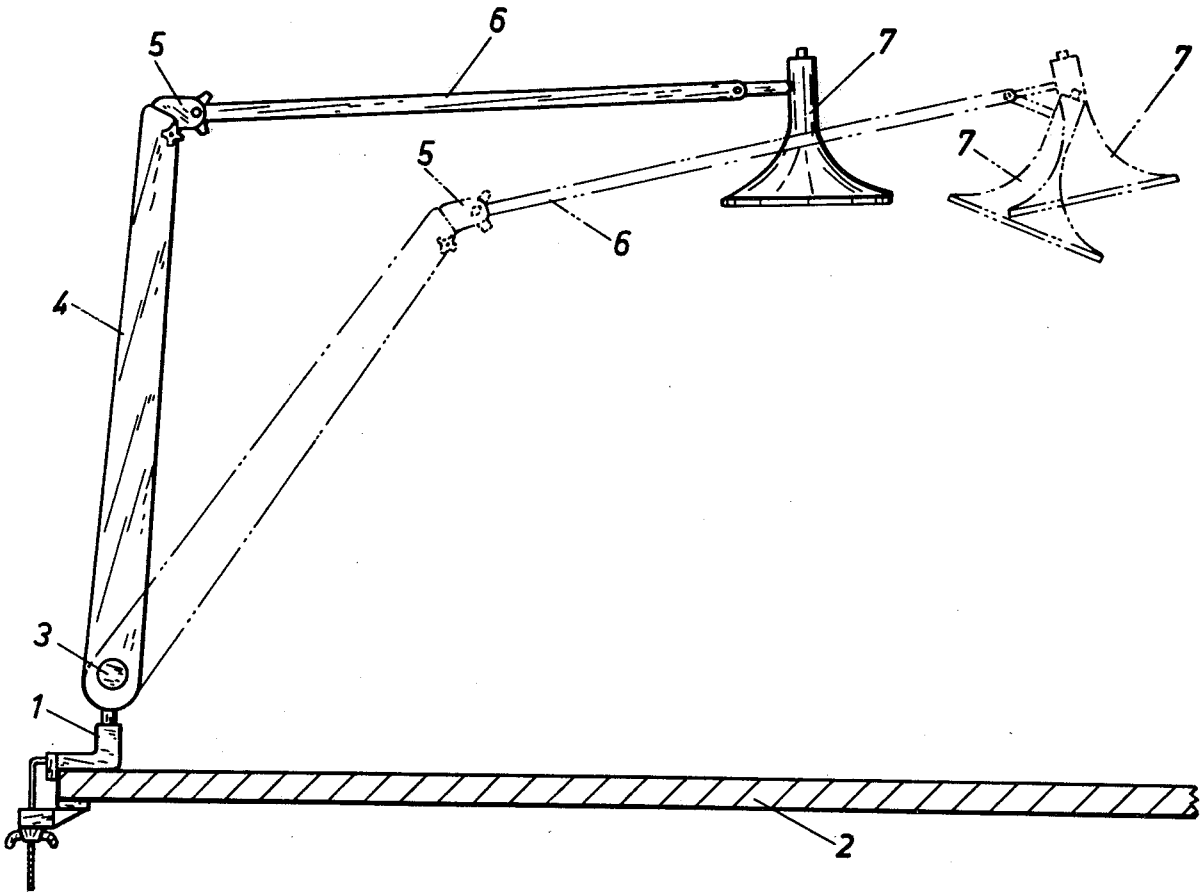
FIG. 1 shows the improved working lamp in accordance with the invention attached to a table top.

The working lamp illustrated in FIG. 1 is secured to a table top 2 by means of an attachment fitting 1. A horizontal shaft 3 forms the pivot axis about which the lower end of a lower pivotable arm 4 is arranged to pivot while the upper end of the arm is pivotally connected to an upper pivotable arm 6 via a joint segment 5. The upper pivotable arm 6 supports light fittings 7 of a well-known type.

Figure 2:
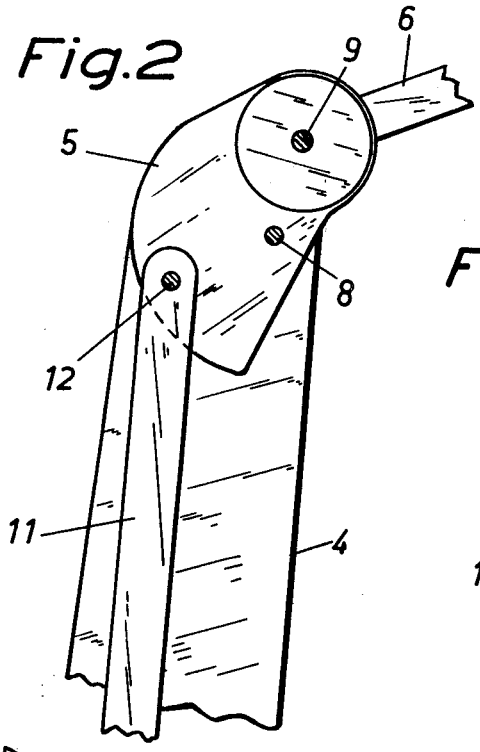
FIGS. 2 and 3 show in a broken view and on an enlarged scale the lower pivotable arm of the lamp in various angular positions.
Figure 3:
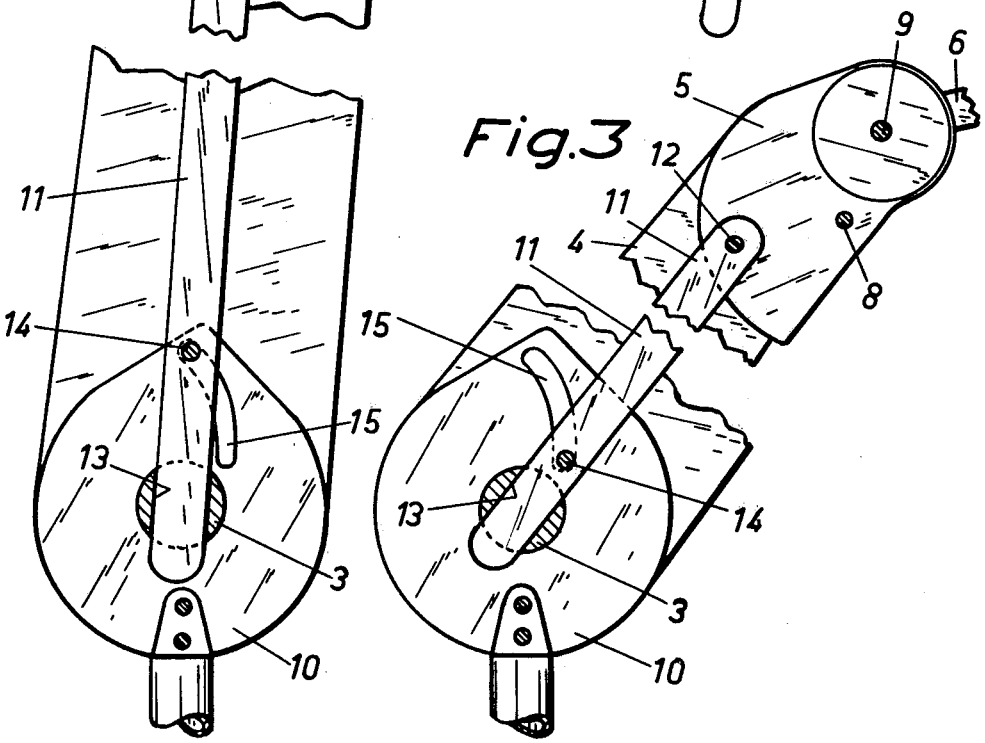

The joint segment 5, see FIGS. 2 and 3, is pivotally connected to the lower pivotable arm 4 via a shaft 8. The upper pivotable arm 6 is arranged to pivot about a shaft 9 in a frictional-type of joint provided in the segment 5.

Between a housing 10 in which the lower arm 4 is mounted on the shaft 3 and the segment 5 extends a rail 11 which is connected to the segment via a pivot shaft 12. The shaft 3 is formed with a groove 13 in which the rail 11 is arranged to move in its lengthwise direction and which groove serves to guide the rail. In the embodiment illustrated in the drawings, the rail 11 is provided at its lower end with a pin 14 engaging in a slot 15 formed in the wall of the housing 10. The slot 15 forms a guiding track to guide the pin 14 and describes a curve from a radially maximum distance from the lower pivot shaft 3 of the lower arm 4 to a minimum distance from said shaft.

Figure 4:
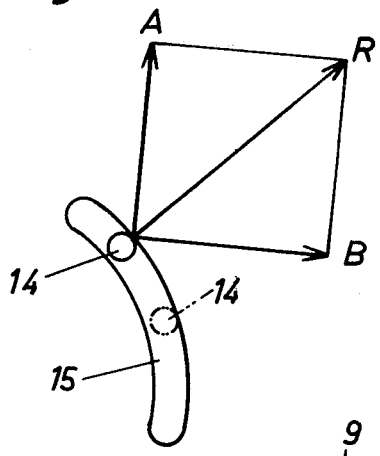
FIG. 4 illustrates schematically the forces acting on a guide track included in the lamp arrangement in accordance with the invention.

Irrespective of in which position the working lamp is set the moment of load of the light fittings 7 is transferred in accordance with the invention via the upper pivotable arm 6, the segment 5, the rail 11 and the pin 14 to the outer edge of the slot 15. FIG. 4 illustrates the manner in which the forces involved act in a predetermined set position of the lamp. The vector A indicates the force tending to pull the upper pivotable arm 6 downwards. The vector B indicates the force tending to pivot the lamp downwards about the horizontal shaft 3. If the vector A is of a sufficient magnitude, that is, if the moment of leverage exerted by the light fittings 7 is of a necessary minimum magnitude, the resultant R will be directed radially outwards from the slot 15, as illustrated in FIG. 4. This means that the working lamp will remain stable in any position in which it is set. Should the load increase, for instance if the light fittings 7 are replaced by other, heavier fittings, the pressure exerted by the pin 14 on the edge of the slot 15 will increase, and consequently the force acting to retain the lamp in any position wherein it is set is increased accordingly. Inversely, by raising the light fittings 7 somewhat, that is, by reducing the vector A somewhat, the lamp will automatically move from the position shown in FIG. 1 in continuous lines to the position shown in dash-anddot lines therein. During this movement, the light fittings 7 move in parallel with the table top 2.

The working lamp in accordance with the invention thus offers the considerable advantage that one and the same arm structure can be used for light fittings of various sizes and weights without any adaptation whatsoever of the structure to new conditions with regard to the moments of leverage involved.

The invention is not limited to the embodiment as shown and described in the aforegoing but a variety of modifications are possible within the scope of the appended claims. For instance, the slot 15 may be positioned elsewhere than in the wall of the housing, such as below the shaft 3 and may extend in another direction towards the shaft centre, in which case the pin 14 will abut against the opposite edge of the slot.

In addition, the rail 11 may be guided in another manner than by means of the groove 13 in the shaft 3.

Within the scope of the principal claim it is likewise possible to provide a pin-and-slot coupling arrangement in a mirror fashion to the one shown, that is to provide the pin 14 on the inner face of the wall of the housing 10 whereby the pin will travel in a slot formed in the rail 11. In this case the rail 11 should be broader than as illustrated in the drawings.

I claim:

1. An arrangement in working lamps of the kind comprising an upper pivotable arm, light fittings supported at the outer end of said upper arm, a lower pivotable arm, a housing at the lower end of said lower pivotable arm, a horizontal shaft in said housing, said lower pivotable arm arranged for pivotal movements about said horizontal shaft, a segment interconnecting said pivotable arms, a first and a second pivot shafts arranged on said segment, each one of said pivotable arms hingedly connected to said segment so as to pivot about its respective one of said first and second pivot shafts, the improvement comprising a rail extending essentially in parallel with said lower pivotable arm, a third pivot shaft arranged on said segment, said rail pivotally connected to said segment so as to pivot about said third pivot shaft, a guide means, said rail axially displaceable in said guide means relative to said lower pivotable arm, a pin-and-slot coupling arrangement, said rail cooperating with said housing by means of said pin-and-slot coupling arrangement, said slot serving as a track to guide said pin and extending in a curve, from a maximum radial distance from the lower pivot shaft of said lower pivotable arm to a maximum distance from said shaft, in addition to which said slot serves to take on one of its edges any moments of load exerted by said light fittings in any one of their set positions and transmitted via said upper pivotable arm, said segment and said rail.

2. An arrangement in working lamps as claimed in claim 1, wherein said pin is formed on said rail and said slot is formed in the wall of said housing.

3. An arrangement as claimed in claim 1, comprising a groove in said lower pivot shaft of said lower pivotable arm, said groove serving to guide said rail upon displacement of the latter.

* * * * *